US007805838B2

(12) United States Patent
Morana et al.

(10) Patent No.: US 7,805,838 B2
(45) Date of Patent: Oct. 5, 2010

(54) METHOD OF FORMING AN ELECTRICAL CONNECTOR

(75) Inventors: Francis P. Morana, Shrewsbury, MA (US); Mark M. Ayzenberg, Hudson, NH (US)

(73) Assignee: Hypertronics Corporation, Hudson, MA (US)

( * ) Notice: Subject to any disclaimer, the term of this patent is extended or adjusted under 35 U.S.C. 154(b) by 35 days.

(21) Appl. No.: 11/882,555

(22) Filed: Aug. 2, 2007

(65) Prior Publication Data

US 2009/0036003 A1 Feb. 5, 2009

(51) Int. Cl.
*H01R 43/00* (2006.01)

(52) U.S. Cl. ..... 29/868; 29/876; 29/881; 29/882; 439/675; 439/843; 439/851; 439/882; 439/891

(58) Field of Classification Search ..... 29/868, 29/872, 876, 878, 881, 882; 439/675, 843, 439/844, 847, 851, 882, 891
See application file for complete search history.

(56) References Cited

U.S. PATENT DOCUMENTS

| | | | | |
|---|---|---|---|---|
| 2,881,364 | A | 4/1959 | Demer et al. | |
| 3,107,966 | A | 10/1963 | Bonhomme | |
| 3,470,527 | A | 9/1969 | Bonhomme | |
| 3,873,889 | A | 3/1975 | Leyba | |
| 4,811,165 | A | 3/1989 | Currier et al. | |
| 4,922,199 | A | 5/1990 | Fukui et al. | |
| 4,958,260 | A | 9/1990 | Kobayashi et al. | |
| 5,326,289 | A | 7/1994 | Leisey | |
| 5,599,348 | A | 2/1997 | Gentelia et al. | |
| 5,920,750 | A | 7/1999 | Wayman et al. | |
| 6,016,253 | A | 1/2000 | Seitz et al. | |
| 6,102,746 | A | 8/2000 | Nania et al. | |
| 6,102,907 | A * | 8/2000 | Smethers et al. | 606/40 |
| 6,164,838 | A | 12/2000 | Maehara et al. | |
| 6,165,173 | A | 12/2000 | Kamdar et al. | |
| 6,296,636 | B1 | 10/2001 | Cheng et al. | |
| 6,511,478 | B1 | 1/2003 | Burnside et al. | |
| 6,515,228 | B2 | 2/2003 | Albert et al. | |
| 6,617,518 | B2 | 9/2003 | Ames et al. | |
| 6,767,260 | B2 | 7/2004 | Beloritsky et al. | |
| 6,849,074 | B2 | 2/2005 | Chen et al. | |
| 6,923,057 | B2 | 8/2005 | Sabatino | |
| 7,048,586 | B2 * | 5/2006 | Ishizaki et al. | 439/607.44 |

FOREIGN PATENT DOCUMENTS

| | | |
|---|---|---|
| WO | WO 00/40065 | 7/2000 |

* cited by examiner

*Primary Examiner*—Thiem Phan
(74) *Attorney, Agent, or Firm*—Finnegan, Henderson, Farabow, Garrett & Dunner, LLP

(57) ABSTRACT

A method of forming an electrical connector includes winding a conducting wire around a carrier strip, cutting the carrier strip to a desired length, forming the carrier strip into a cylindrical member to form an inner tube subassembly, and inserting the inner tube subassembly into an outer tube.

19 Claims, 9 Drawing Sheets

METHOD OF FORMING AN ELECTRICAL CONNECTOR

FIELD OF THE INVENTION

The present invention relates generally to an electrical connector, and more particularly, to a method of forming an electrical connector.

BACKGROUND OF THE INVENTION

Electrical connectors having coaxial contact structures are typically used to connect two coaxial cables to one another. A coaxial cable has an inner and an outer conductor member which share a common axis. Coaxial cables are often used in applications where it is desirable to operate at high frequencies while reducing the interference of a high frequency signal. For this reason, the outer conductor member of a coaxial cable will often serve as a shield for the inner conductor member which carries the signal. Alternately, the outer conducting member of a coaxial cable may be used to carry an additional signal.

The outer contact structure of a conventional coaxial electrical connector may have contact wires formed as a hyperboloid in order to improve the quality of electrical contact. For example, a method of manufacturing an electrical connector socket that includes a plurality of wires that form a hyperboloid is described in U.S. Pat. No. 3,470,527 ("the '527 patent") and U.S. Pat. No. 3,107,966 to Bonhomme. In the '527 patent, the wires are disposed inside a tubular sleeve. The ends of the wires are folded over the respective ends of the tubular sleeve and onto an outer surface of the tubular sleeve. The tubular sleeve is slipped into a tubular piece so that the ends of the wires are wedged or pinched between the outside surface of the tubular sleeve at the ends of the tubular sleeve and an inside surface of the tubular piece.

The '527 patent describes forming an electrical connector socket having wires that form a hyperboloid. However, the method of manufacturing the electrical connector socket requires a press fit operation to ensure that the ends of the wires are held in place between the tubular sleeve and the tubular piece and to ensure that the wires maintain the hyperboloid formation. Therefore, the wires and/or the tubular sleeve is press fit into the tubular piece. However, it may be difficult to compress the solid, cylindrical tubular sleeve towards its axis.

In addition, in conventional electrical connector sockets such as the one shown in the '527 patent, two tubular pieces may be provided so that one tubular piece is inserted over the ends of the wires folded over one end of the tubular sleeve, and the other tubular piece is inserted over the ends of the wires folded over the other end of the tubular sleeve. As a result, the method of manufacturing the electrical connector socket may be expensive, complicated, and slow.

SUMMARY OF THE INVENTION

In one aspect, the present disclosure is directed to a method of forming an electrical connector. The method includes winding a conducting wire around a carrier strip, cutting the carrier strip to a desired length, forming the carrier strip into a cylindrical member to form an inner tube subassembly, and inserting the inner tube subassembly into an outer tube.

In another aspect, the present disclosure is directed to an electrical connector. The electrical connector includes an outer tube and an inner tube subassembly disposed inside the outer tube. The inner tube subassembly includes a cylindrical member having a gap extending in an axial direction of the cylindrical member, and a conducting wire wound around the cylindrical member.

In a further aspect, the present disclosure is directed to a method of forming an electrical connector. The method includes forming a plurality of notches in a carrier strip and winding a conducting wire around the carrier strip by positioning the conducting wire in the notches of the carrier strip. The method also includes forming the wire-wrapped carrier strip into a cylindrical member to form an inner tube subassembly and inserting the inner tube subassembly into an outer tube so that the conducting wire contacts an inner surface of the outer tube. The conducting wire is positioned in a hyperboloid configuration inside the inner tube subassembly.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to exemplary embodiments of the invention, examples of which are illustrated in the accompanying drawings. Wherever possible, the same reference numbers will be used throughout the drawings to refer to the same or like parts.

According to an embodiment, a female electrical connector may be provided for contacting a male counterpart. The female electrical connector includes an outer structure and an inner structure. The outer structure has a longitudinal axis and an inner surface for receiving a contact member of the male counterpart. The outer structure further includes a conductive contact structure mounted within the outer structure for contacting the contact member of the male counterpart upon insertion of the contact member of the male counterpart into the outer structure of the female electrical connector.

Figure 1:
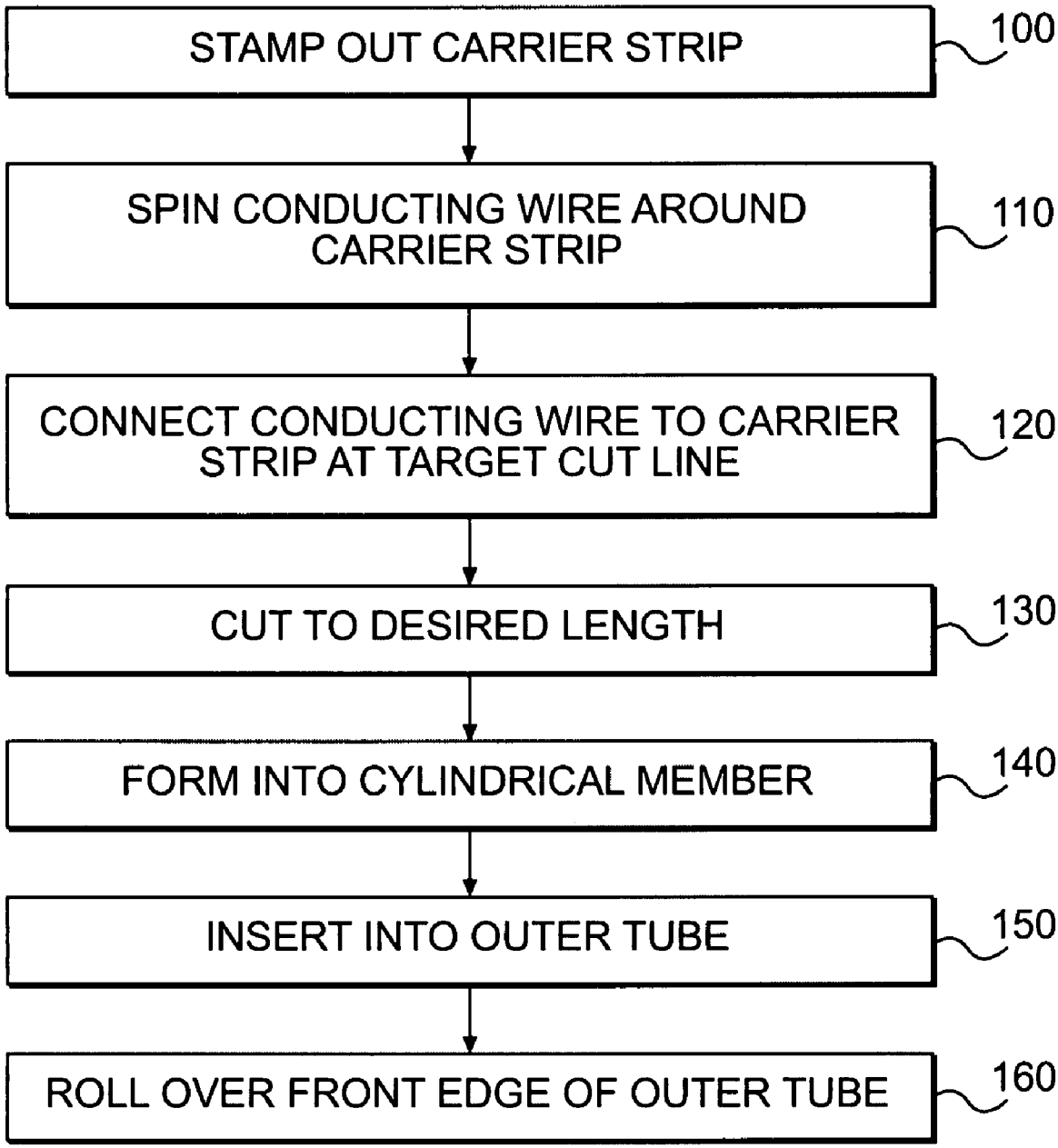
FIG. 1 is a flow chart illustrating an exemplary disclosed method of forming an electrical connector.

FIG. 1 is a flow chart illustrating an exemplary embodiment of a method of forming an electrical connector 50 (FIGS. 6-9), e.g., the female or male electrical connector described above. First, a carrier strip 10 may be selected based on desired dimensions, such as width (i.e., distance between edge 10*a* and edge 10*b*) and thickness (depth, i.e., distance between a top surface and a bottom surface of the carrier strip 10), and/or material. The carrier strip 10 and other components of the electrical connector 50 may be made of a variety of materials including, but not limited to, brass, beryllium, copper, or any conventional material used for electrical connectors. In one example, the width of the carrier strip 10 is between 0.5 and 20 millimeters. In another embodiment, the width of the carrier strip 10 is between 2 and 10 millimeters.

In yet another embodiment, the width of the carrier strip 10 is between 3 and 4 millimeters. The width, thickness, desired length (described below), and/or other dimension of the carrier strip 10 may be determined based on any suitable electrical or physical characteristic. In one example, it is determined based on the current that passes through the electrical connector 50.

Figure 2:
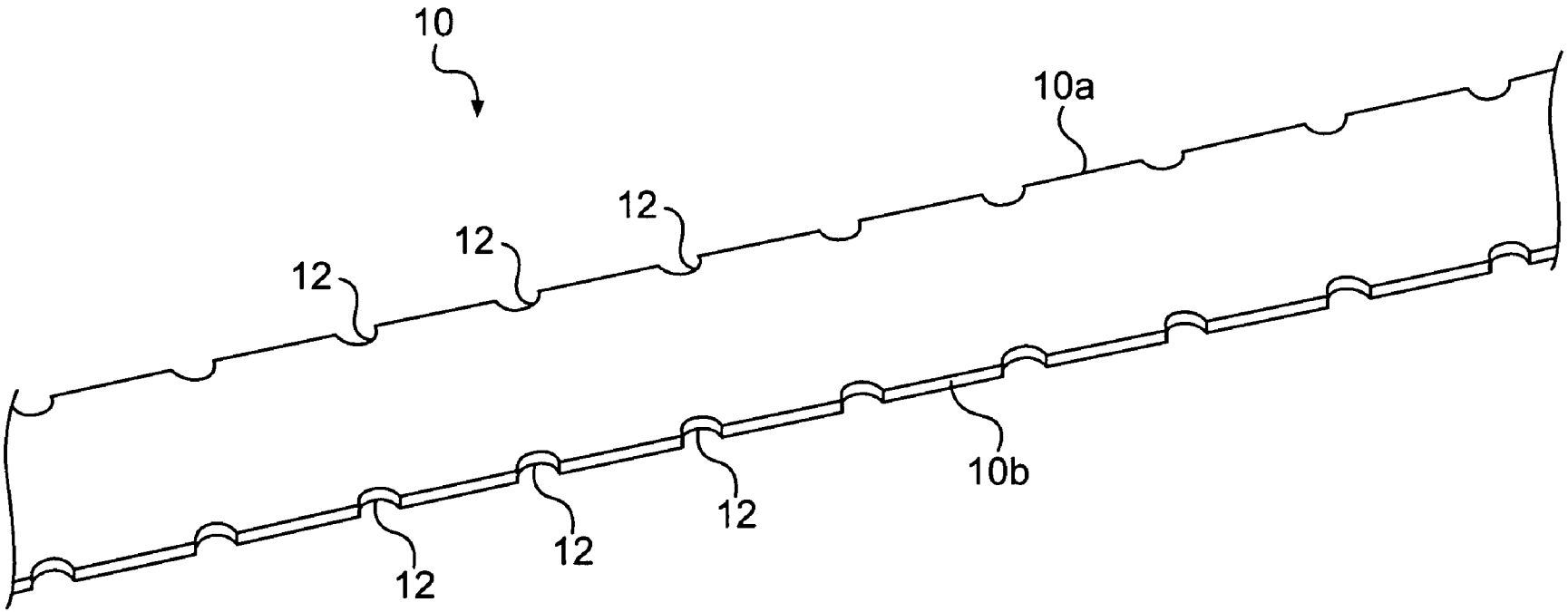
FIG. 2 is a perspective view of a carrier strip of an exemplary disclosed electrical connector.

As shown in FIG. 2, the carrier strip 10 includes a plurality of notches 12 (step 100). The notches 12 may be formed by a variety of methods, including stamping. The notches 12 may extend through the thickness of the carrier strip 10. According to the embodiment shown in FIG. 2, the notches 12 are placed in a staggered pattern along the two lengthwise edges 10*a*, 10*b* of the carrier strip 10. For example, each of the notches 12 on one edge 10*a* may be generally aligned with a midpoint between two adjacent notches 12 on the other edge 10*b*. Alternatively, the notches 12 may be formed in other patterns, e.g., the notches 12 on one edge 10*a* may be generally aligned with the notches 12 on the other edge 10*b*.

As shown in FIG. 2, the notches 12 may be formed as semicircles. Alternatively, the notches 12 may be formed in other geometrical shapes, such as squares, V-shapes, etc., that allow the notches 12 to at least partially receive a conducting wire 20 (FIG. 3) that is wrapped around the carrier strip 10. Alternatively, instead of the notches 12, the carrier strip 10 may includes a plurality of protrusions or nubs or other components for positioning the conducting wire 20 with respect to the carrier strip 10. The size (e.g., radius) and location of the notches may depend on a variety of factors, such as, but not limited to, the size of the conducting wire 20, the width of the carrier strip 10, an angle of the conducting wire 20 with respect to a length of the carrier strip 10 when wrapped around the carrier strip 10, a desired spacing of the conducting wire 20 along the lengthwise direction, etc. After being stamped with the notches 12, the carrier strip 10 may be wound lengthwise onto a reel (not shown).

Figure 3:
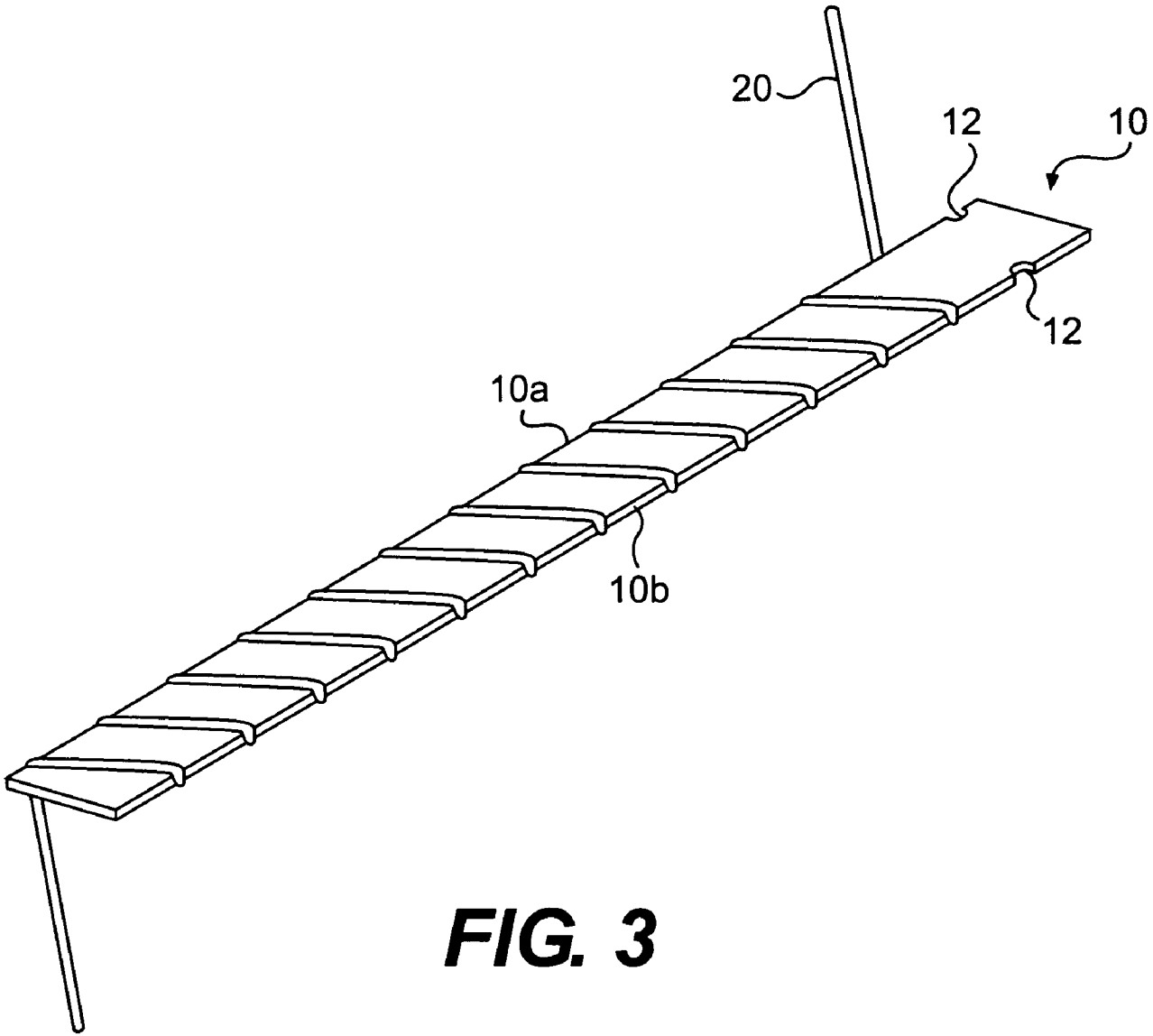
FIG. 3 is a perspective view of a wire wrapped around the carrier strip of FIG. 2.

Next, the carrier strip 10, which may be wound onto the reel, may be fed through a braiding machine (not shown) that spins the conducting wire 20 around the carrier strip 10 (step 110). FIG. 3 shows the carrier strip 10 and the conducting wire 20 after the conducting wire 20 is wound around (e.g., braided with) the carrier strip 10. The conducting wire 20 may be a single conducting wire 20, e.g., provided from a reel. The conducting wire 20 is wound around the width of the carrier strip 10 so that the conducting wire 20 may be held in place by each of the notches 12 in the carrier strip 10. The conducting wire 20 may be gold-plated and/or may be made of a variety of materials including, but not limited to, brass, beryllium, copper, or any conventional material used for electrical connectors. After the conducting wire 20 is wound around the carrier strip 10, the wire-wrapped carrier strip 10 may be wound onto the reel or another reel.

Figure 4:
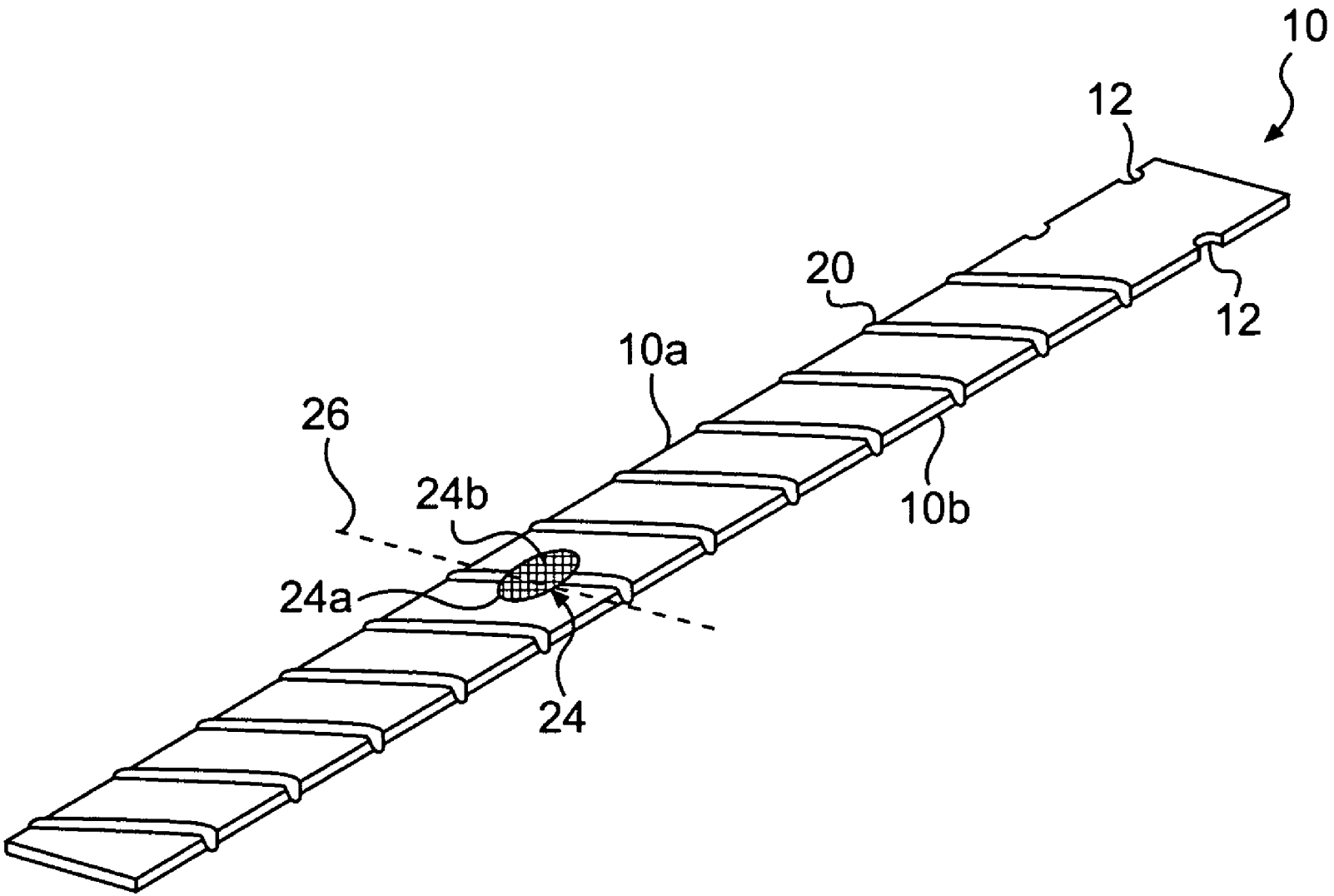
FIG. 4 is a perspective view of the wire-wrapped carrier strip of FIG. 3 including a connection.

Then, as the wire-wrapped carrier strip 10 is unwound from the reel and before cutting the wire-wrapped carrier strip 10 to a desired length, the conducting wire 20 may be connected at one or more locations to the carrier strip 10 (step 120) to secure the conducting wire 20 to the carrier strip 10. For example, as shown in FIG. 4, a connection 24 may be formed between the conducting wire 20 and the carrier strip 10 by soldering, welding, bonding, attaching, affixing, joining, etc. In one embodiment, the connection 24 may be formed at a target cut line 26. The target cut line 26 is determined based on the desired length of the wire-wrapped carrier strip 10 for forming an inner tube subassembly 30 (FIGS. 5-9) described below. Also, the connection 24 may be formed so that the connection 24 includes a first portion 24*a* on one side of the target cut line 26 and a second portion 24*b* on the other side of the target cut line 26. As a result, after cutting the wire-wrapped carrier strip 10 and removing a cut portion of the wire-wrapped carrier strip 10 from a remainder of the wire-wrapped carrier strip 10, the cut and remainder portions of the conducting wire 20 may be prevented from unraveling from the respective cut and remainder portions of the carrier strip 10. Specifically, the first portion 24*a* of the connection 24 may prevent the conducting wire 20 from unraveling from the cut portion of the carrier strip 10, and the second portion 24*b* of the connection 24 may prevent the conducting wire 20 from unraveling from the remainder portion of the carrier strip 10, e.g., the portion wound on the reel.

Figure 5:
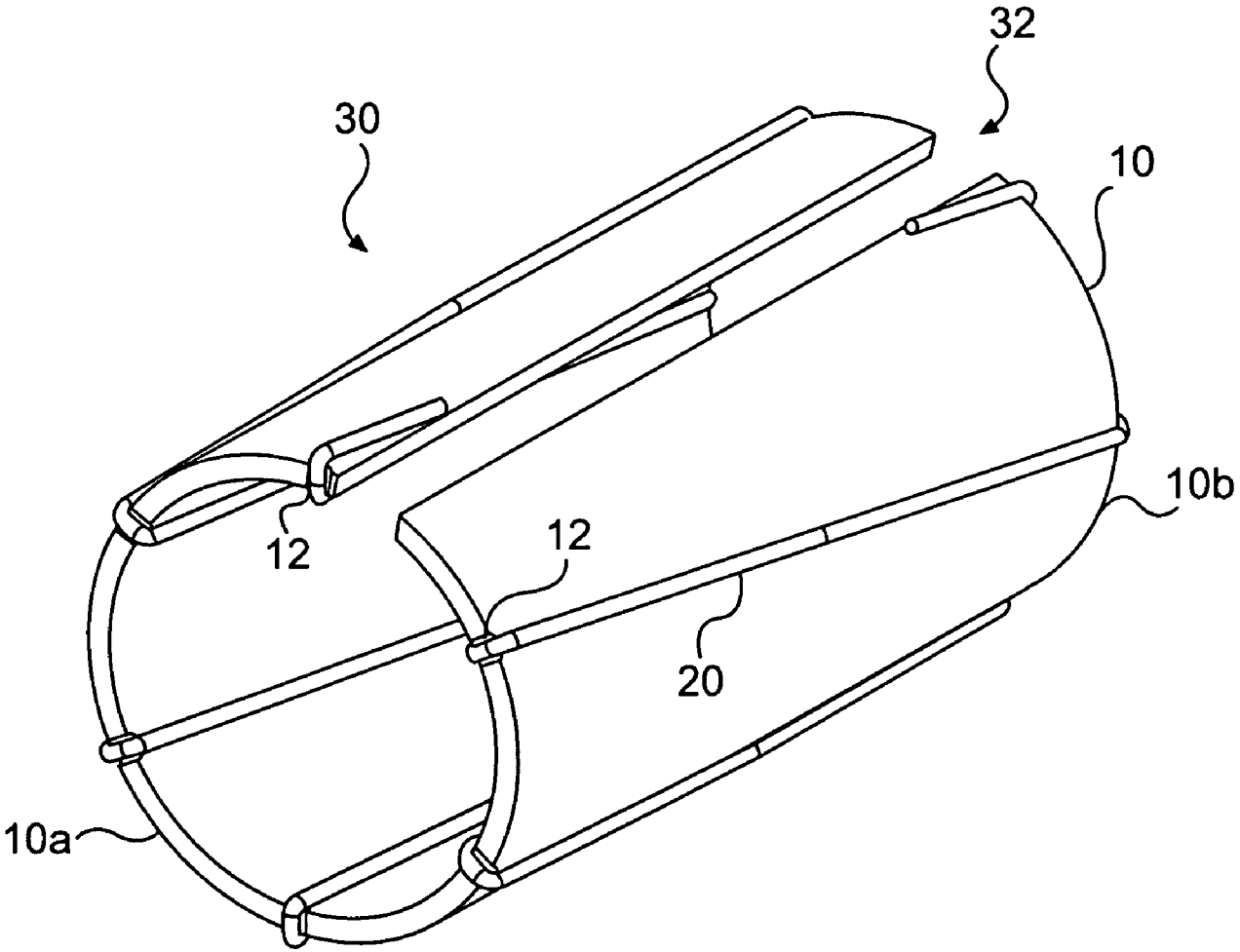
FIG. 5 is a perspective view of the connected wire-wrapped carrier strip of FIG. 4 formed into a cylindrical member to form an inner tube subassembly.

As shown in FIG. 5, the wire-wrapped carrier strip 10 may then be cut to the desired length (step 130) and formed (e.g., rolled, bent, curled, etc.) into a cylindrical or barrel shape with a predetermined diameter (step 140), thereby forming the inner tube subassembly 30. As a result, the edges 10*a*, 10*b* of the carrier strip 10 on which the notches 12 are formed may form respective ends of the inner tube subassembly 30 in the axial direction of the inner tube subassembly 30. Also, when formed into the cylindrical shape, two opposing edges that extend between the edges 10*a*, 10*b* of the wire-wrapped carrier strip 10 may form a gap 32 that extends in the axial direction of the inner tube subassembly 30. When the inner tube subassembly 30 is formed, the conducting wire 20 may form a contact having a general hyperboloid shape. For example, the hyperboloid formed by the conducting wire 20 may have two ends and a throat portion between the two ends, and the throat portion may have a diameter that is smaller than the diameters at the ends. The characteristics of the hyperboloid-shaped contact may be varied based on, e.g., the spacing of the conducting wire 20 (which depends on the spacing of the notches 12 on both edges 10*a*, 10*b* of the carrier strip 10) and the shape and other characteristics of the conducting wire 20. For example, the notches 12 on each edge 10*a*, 10*b* may be close or far apart from each other. Also, the notches 12 on one edge (e.g., edge 10*a*) may be offset from notches 12 on the other edge (e.g., edge 10*b*) by a small or large amount.

Figure 6:
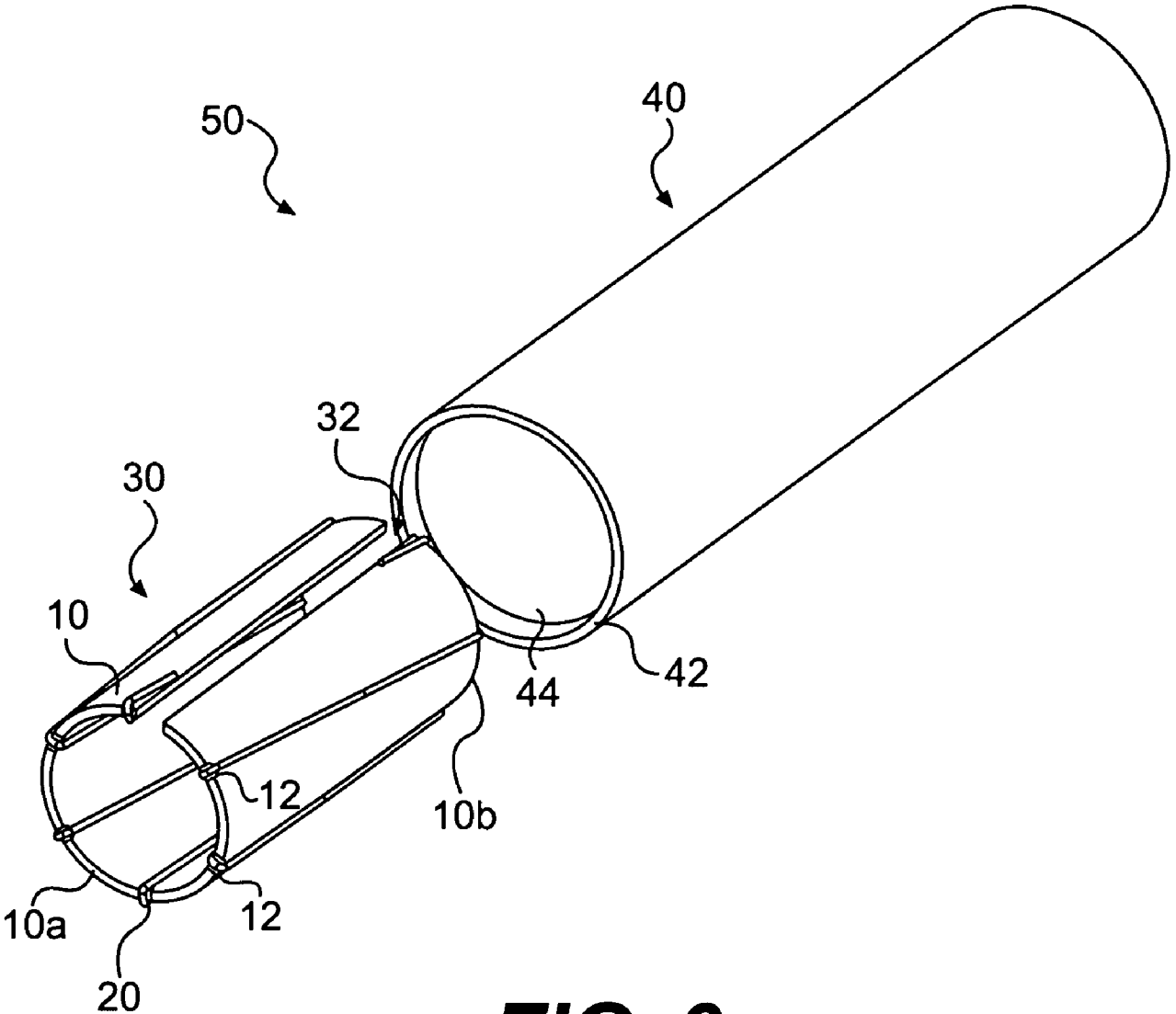
FIG. 6 is a perspective view of an outer tube and the inner tube subassembly of FIG. 5.
Figure 7:
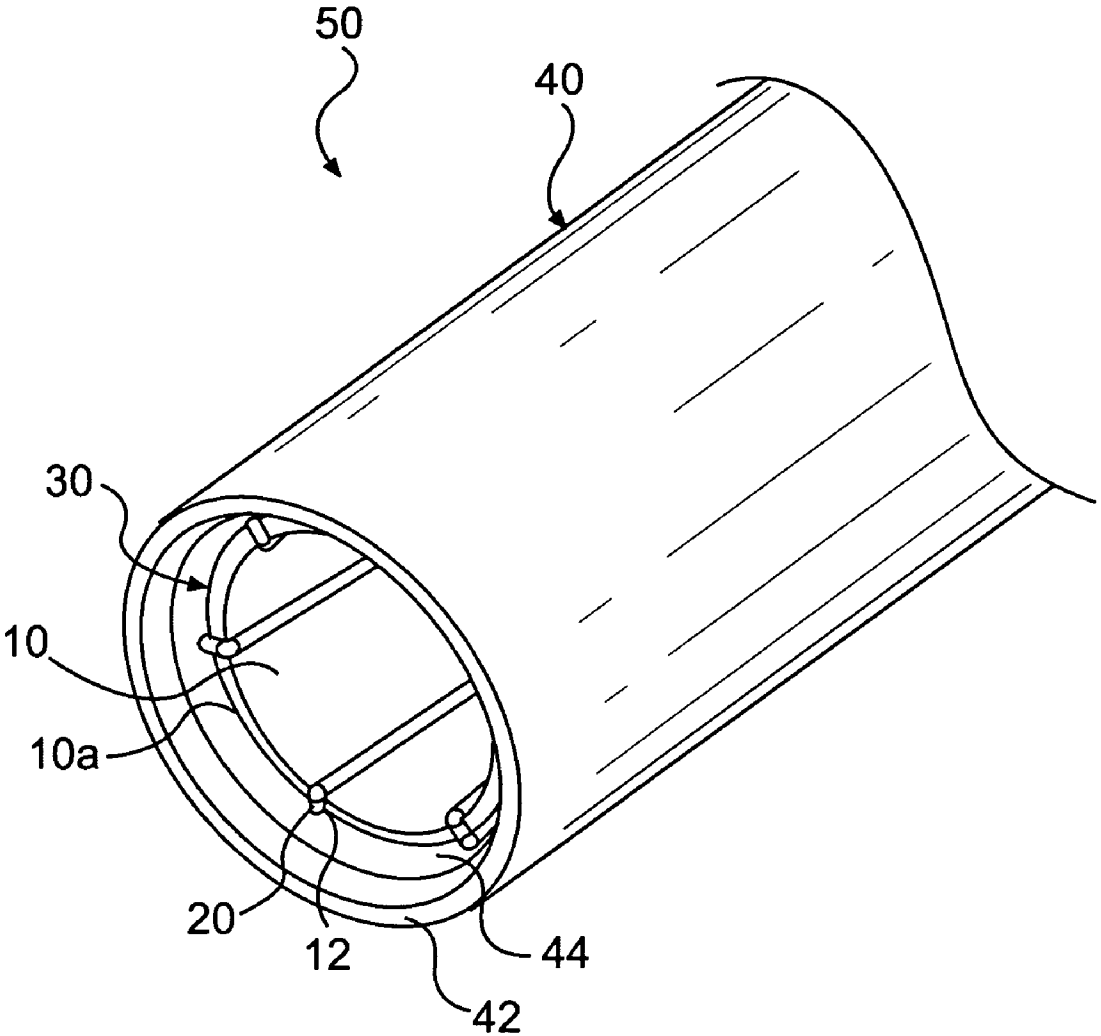
FIG. 7 is a perspective view of the electrical connector including the inner tube subassembly of FIG. 5 inserted into the outer tube of FIG. 6.

After the inner tube subassembly 30 is formed, the inner tube subassembly 30 is inserted into an outer tube 40 (rear tail) (step 150). FIG. 6 shows the inner tube subassembly 30 and the outer tube 40 before the insertion of the inner tube subassembly 30 into the outer tube 40, and FIG. 7 shows the inner tube subassembly 30 inserted into the outer tube 40. In one example, the outer tube 40 may have an outer diameter of approximately 1 millimeter. Alternatively, the outer diameter of the outer tube 40 may be less than or greater than 1 millimeter. The outer tube 40 may have an inner diameter that is at least slightly greater than the diameter of the inner tube subassembly 30, and the inner tube subassembly 30 and the outer tube 40 may share a common axis. The inner tube subassembly 30 may be pressed into the outer tube 40 by compressing the inner tube subassembly 30 slightly, which may be accomplished by decreasing the size of the gap 32, e.g., by pinching or pressing together the two opposite edges of the inner tube subassembly 30 facing the gap 32. Then, the inner tube subassembly 30 may be inserted into the outer tube 40 so that the conducting wire 20 contacts an inner surface 44 of the outer tube 40. In the embodiment shown in FIG. 6, the end of the inner tube subassembly 30 formed by the edge 10*a* of the carrier strip 10 is located nearest to a front edge 42 of the outer tube 40 when the inner tube subassembly 30 is disposed inside the outer tube 40.

Figure 8:
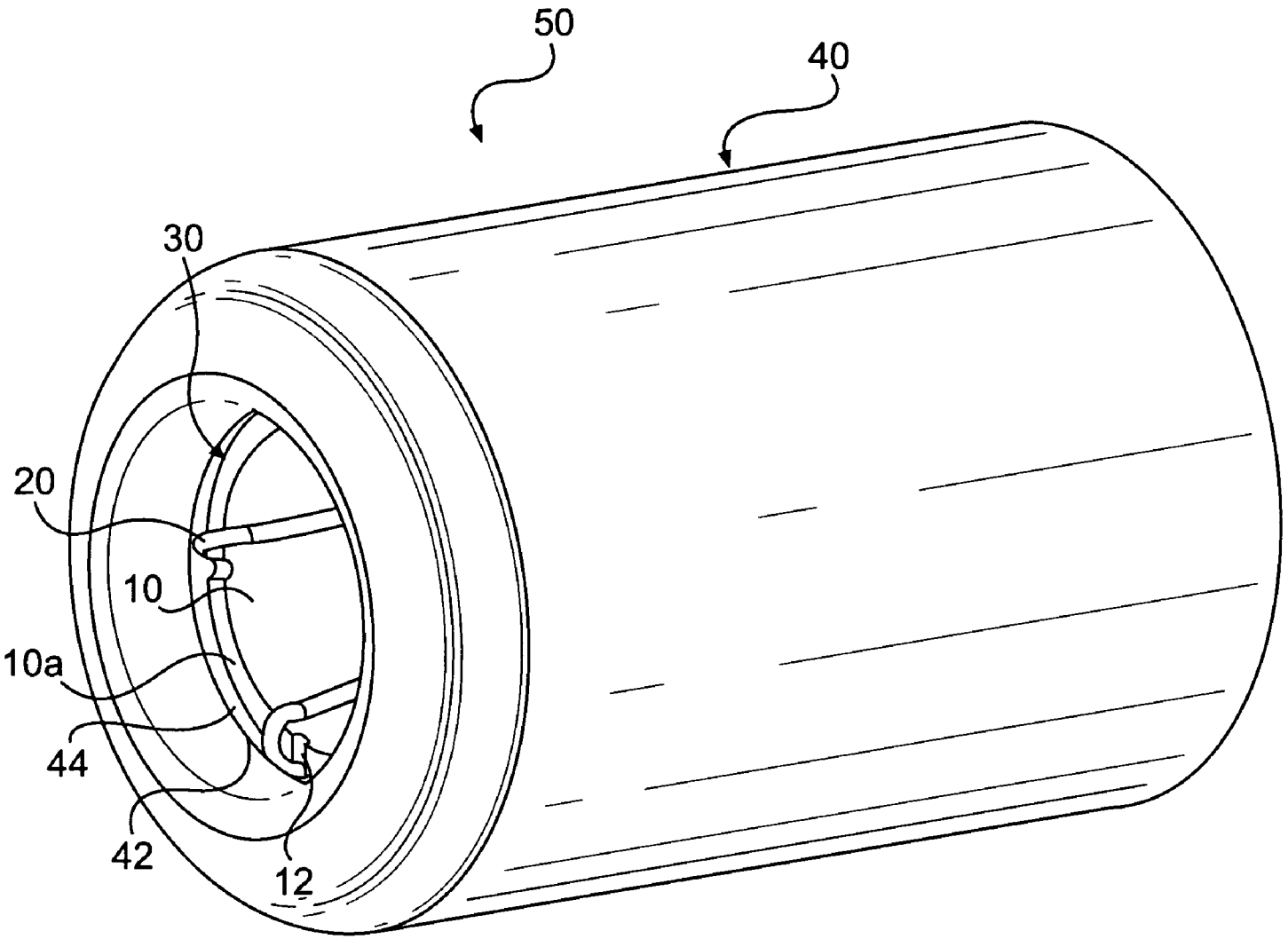
FIG. 8 is a perspective view of the electrical connector of FIG. 7 having a rolled-over front edge.
Figure 9:
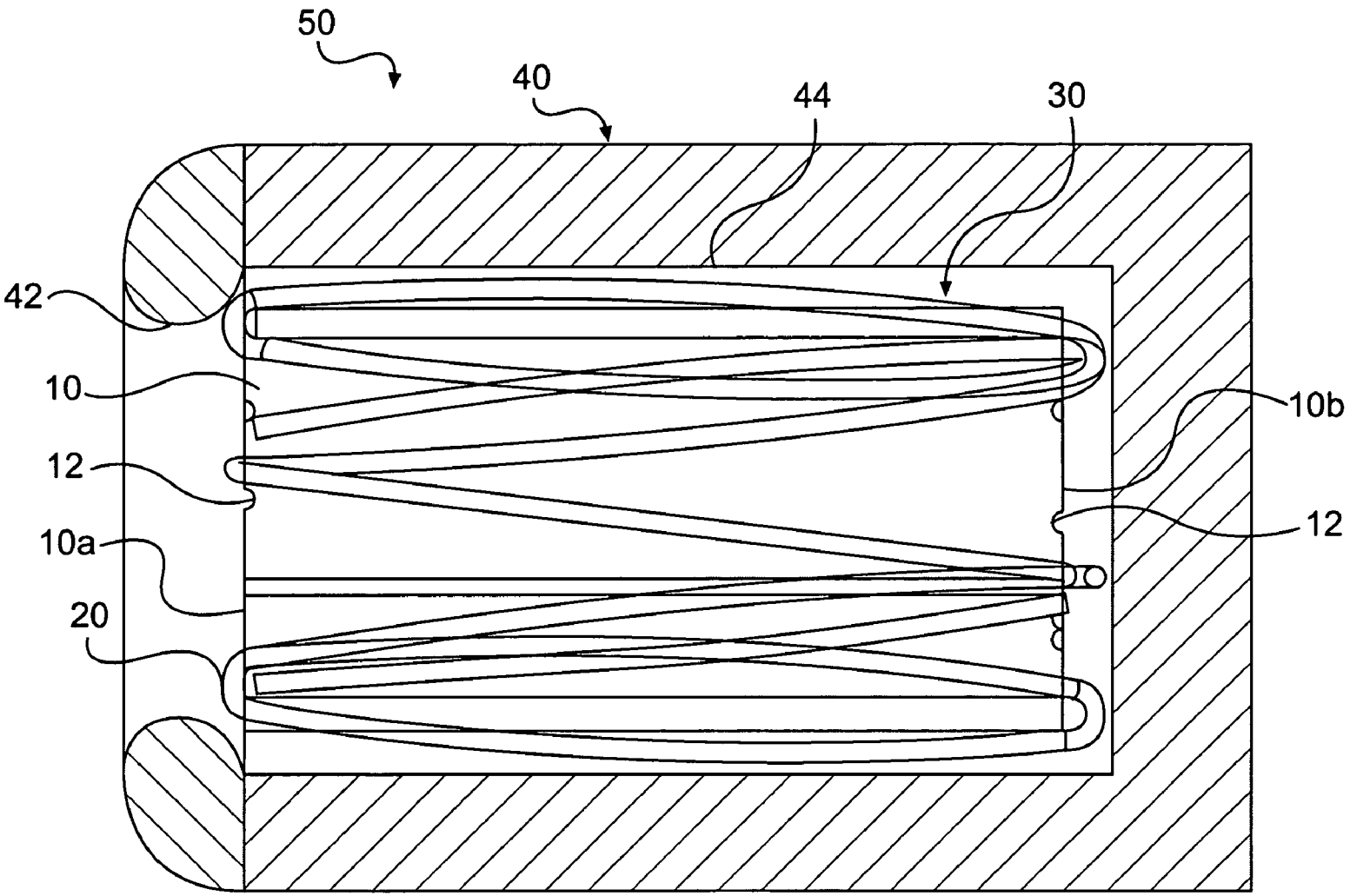
FIG. 9 is a cross-sectional view of the electrical connector of FIG. 8.

Next, as shown in FIGS. 8 and 9, in certain embodiments, the front edge 42 of the outer tube 40 may be rolled over or bent so that the inner tube subassembly 30 may be captured or trapped inside the outer tube 40 (step 160), thereby forming the electrical connector 50. For example, the front edge 42 may be rolled over or bent so that the front edge 42 or other surface of the outer tube 40 faces a front end of the inner tube subassembly 30 formed by the edge 10*a* of the carrier strip 10. The front edge 42 may be rolled over so that there may be a gap, e.g., of approximately 0.01 to 1 millimeter, between the front edge 42 of the outer tube 40 and the edge 10*a* of the carrier strip 10 (or the conducting wire 20 at the edge 10*a* of the carrier strip 10). As a result, the inner tube subassembly 30 may be slidable in the axial direction. The gap may be shorter or longer, depending on one or more factors, such as the size of the outer tube 40, the size of the inner tube subassembly 30, the difference in length between the inner surface 44 of the outer tube 40 and the inner tube subassembly 30, etc. For example, in one embodiment, the front edge 42 may be rolled over far enough so that the inner tube subassembly 30 does not contact the front edge 42 and so that the inner tube subassembly 30 is not damaged.

According to one embodiment, a machine may be used to roll over or bend the front edge 42 of the outer tube 40. While the inner tube subassembly 30 is inserted into the outer tube 40, the outer tube 40 may be spun in place or held in position. Then, the machine may roll over the front edge 42 of the outer tube 40. For example, the machine may include a swedge that produces an axial force on the front edge 42 that presses on the front edge 42, thereby causing the front edge 42 to roll over towards the inner tube subassembly 30 and/or causing the front edge 42 to flatten to create a surface that opposes the inner tube subassembly 30. As a result, the inner tube subassembly 30 is prevented from sliding out of the outer tube 40.

The electrical connector 50 may be used for any type of suitable electrical coupling, e.g., a coaxial connection, a fiber optic connection, a high speed digital connection, etc., and may be formed of any appropriate size. The electrical connector 50 shown in FIG. 7, for example, may be a female electrical connector. In certain embodiments, the electrical connector 50 may be used in harsh environments, including those with significant vibrations.

In at least one embodiment, a single conducting wire 20 may be wound around the carrier strip 10 using any acceptable method, such as by using a braiding machine. As a result, in certain embodiments, the method of manufacturing the electrical connector 50 does not require handling a plurality of individual wires, and also does not require positioning a plurality of wires inside a conventional tubular sleeve to form the hyperboloid shape. Therefore, the method of manufacturing the electrical connector 50 may be simple and easy to automate, and therefore may be efficient, fast, and inexpensive.

When inserting the inner tube subassembly 30 into the outer tube 40, in certain embodiments, the inner tube subassembly 30 may be compressed only slightly. The inner tube subassembly 30 may be easier to compress and less likely to be damaged due to the gap 32 as compared to a solid tubular sleeve that is press fit into the outer tube 40. Therefore, the method of manufacturing the electrical connector 50 may have less risk of damage to the components.

Furthermore, since the front edge 42 of the outer tube 40 may be rolled over and into the outer tube 40, a forward ring or other similar type of component for trapping the inner tube subassembly 30 inside the outer tube 40 may be eliminated. In addition, in certain embodiments, only a single outer tube 40 is necessary since there are no wire edges that need to be folded over and press fitted at each end of the inner tube subassembly 30. Moreover, in certain embodiments, a single conducting wire 20 may be used with the notches 12 to help keep the conducting wire 20 in place. Therefore, the method of manufacturing the electrical connector 50 may be simpler and may require fewer components and therefore may be more efficient, faster, and less costly.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of forming an electrical connector comprising:
winding a conducting wire around a carrier strip;
cutting the carrier strip to a desired length;
modifying the shape of the carrier strip into a cylindrical member to form an inner tube subassembly; and
inserting the inner tube subassembly into an outer tube.

2. The method of claim 1, wherein the conducting wire is wound around the carrier strip when the carrier strip is cut to the desired length and formed into the cylindrical member.

3. The method of claim 1, wherein the conducting wire is wrapped around a width of the carrier strip, and the carrier strip is rolled along a lengthwise dimension of the carrier strip to form the carrier strip into the cylindrical member.

4. The method of claim 1, wherein, during the winding of the conducting wire, a single conducting wire is wound around the carrier strip.

5. The method of claim 4, further including feeding the carrier strip into a braiding machine, and further wherein the braiding machine winds the single conducting wire around the carrier strip.

6. The method of claim 1, further including forming a plurality of notches in the carrier strip, the conducting wire being held in place by the plurality of notches when wrapped around the carrier strip.

7. The method of claim 6, wherein the plurality of notches are formed in the carrier strip by stamping.

8. The method of claim 6, wherein the plurality of notches are formed in a staggered pattern.

9. The method of claim 1, wherein the conducting wire is in a generally hyperboloid shape when the inner tube subassembly is formed.

10. The method of claim 1, further including rolling over a front edge of the outer tube to capture the inner tube subassembly inside the outer tube.

11. The method of claim 1, further including reeling the carrier strip.

12. The method of claim 1, further including compressing the inner tube subassembly before inserting the inner tube subassembly into the outer tube.

13. The method of claim 12, wherein the inner tube subassembly is compressed by pressing together opposing ends of the carrier strip that extend in an axial direction of the inner tube subassembly.

14. The method of claim 1, wherein the inner tube subassembly is inserted into a single outer tube.

15. The method of claim 1, further including connecting the conducting wire to the carrier strip before cutting the carrier strip to the desired length.

16. The method of claim 15, wherein a connection is formed at a target cut line when connecting the conducting wire to the carrier strip.

17. The method of claim 16, wherein the connection includes a first portion that connects a cut portion of the conducting wire to a cut portion of the carrier strip and a second portion that connects a remainder portion of the conducting wire to a remainder portion of the carrier strip.

18. The method of claim 1, wherein the conducting wire is wound around the carrier strip through at least one rotation.

19. The method of claim 1, wherein the steps are performed in the order recited.

* * * * *